US009417552B2

(12) United States Patent
Kim

(10) Patent No.: US 9,417,552 B2
(45) Date of Patent: Aug. 16, 2016

(54) LIGHT-EMITTING ELEMENT ARRAY MODULE AND METHOD OF CONTROLLING LIGHT-EMITTING ELEMENT ARRAY CHIPS

(71) Applicant: Samsung Electronics Co., Ltd., Suwon-si, Gyeonggi-do (KR)

(72) Inventor: Su-whan Kim, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/532,386

(22) Filed: Nov. 4, 2014

(65) Prior Publication Data

US 2015/0212448 A1 Jul. 30, 2015

(30) Foreign Application Priority Data

Jan. 29, 2014 (KR) ..... 10-2014-0011734

(51) Int. Cl.
*B41J 2/45* (2006.01)
*G03G 15/043* (2006.01)
*H05B 33/08* (2006.01)

(52) U.S. Cl.
CPC ..... *G03G 15/043* (2013.01); *H05B 33/0842* (2013.01)

(58) Field of Classification Search
CPC ..... B41J 2/41; B41J 2/385; G11B 3/00; G03G 13/04; G03G 15/043; H05B 33/0842
See application file for complete search history.

(56) References Cited

U.S. PATENT DOCUMENTS 6,180,960 B1 1/2001 Kusuda et al.
6,496,973 B1 12/2002 Kusuda et al.
6,504,309 B1 1/2003 Ohno
6,531,826 B1 3/2003 Ohno et al.
6,535,234 B2 3/2003 Ohno et al.
6,657,651 B2 12/2003 Ohno
6,693,659 B2 2/2004 Okumura et al.
6,703,790 B2 3/2004 Ohno
6,717,182 B1 4/2004 Tagami et al.
6,717,183 B2 4/2004 Ohno et al.
6,747,940 B2 6/2004 Ohno
6,750,892 B2 6/2004 Suzuki
6,819,352 B2 11/2004 Mizes et al.
6,825,500 B1 11/2004 Komaba (Continued)

FOREIGN PATENT DOCUMENTS

JP 2009-119805 6/2009
WO 2010/100882 A1 9/2010

OTHER PUBLICATIONS

International Search Report and Written Opinion mailed Nov. 21, 2014 in related International Application No. PCT/KR2014/007564.

(Continued)

*Primary Examiner* — Thinh Nguyen

(74) *Attorney, Agent, or Firm* — Staas & Halsey LLP

(57) ABSTRACT

A light-emitting element array module, image forming apparatus and method are provided. The light-emitting element array module includes a control driver configured to receive print data and operate according to the received print data, and light-emitting element array chips configured to receive a signal from the control driver and operate according to the received signal, wherein the control driver applies a start signal to a transfer element array by using a signal applied to a light-emitting element array of the light-emitting element array chips.

30 Claims, 10 Drawing Sheets

(56) References Cited

U.S. PATENT DOCUMENTS

| | | | |
|---|---|---|---|
| 6,876,372 | B2 | 4/2005 | Nagafusa et al. |
| 6,919,583 | B2 | 7/2005 | Tagami et al. |
| 7,009,221 | B2 | 3/2006 | Ohno |
| 7,075,674 | B2 | 7/2006 | Nagumo et al. |
| 7,151,612 | B2 | 12/2006 | Mikami |
| 7,193,250 | B2 | 3/2007 | Ohno |
| 7,215,348 | B2 | 5/2007 | Nomura et al. |
| 7,256,814 | B2 | 8/2007 | Tsujino et al. |
| 7,301,552 | B2 | 11/2007 | Sato |
| 7,330,204 | B2 | 2/2008 | Ohno |
| 7,375,740 | B2 | 5/2008 | Mizes |
| 7,388,593 | B2 | 6/2008 | Fukuda |
| 7,425,971 | B2 | 9/2008 | Yamazaki et al. |
| 7,508,403 | B2 | 3/2009 | Mikami et al. |
| 7,541,620 | B2 | 6/2009 | Sagimori et al. |
| 7,652,683 | B2 | 1/2010 | Akagawa et al. |
| 7,705,869 | B2 | 4/2010 | Tsujino et al. |
| 7,808,520 | B2 | 10/2010 | Nakajima |
| 7,834,363 | B2 | 11/2010 | Ohno |
| 7,855,836 | B2 | 12/2010 | Yamamura |
| 7,871,145 | B1 | 1/2011 | Enge |
| 7,885,006 | B2 | 2/2011 | Yamamura |
| 7,911,492 | B2 | 3/2011 | Tsujino et al. |
| 7,948,004 | B2 | 5/2011 | Suzuki |
| 7,954,917 | B2 | 6/2011 | Inoue |
| 7,982,761 | B2 | 7/2011 | Yokoi |
| 7,989,825 | B2 | 8/2011 | Hamanaka et al. |
| 8,004,549 | B2 | 8/2011 | Nomura et al. |
| 8,023,205 | B2 | 9/2011 | Yamamura |
| 8,040,368 | B2 | 10/2011 | Yokoi |
| 8,041,274 | B2 | 10/2011 | Aoki |
| 8,053,335 | B2 | 11/2011 | Yonehara |
| 8,068,243 | B2 | 11/2011 | Saito |
| 8,081,360 | B2 | 12/2011 | Yasuda et al. |
| 8,089,077 | B2 | 1/2012 | Hamanaka et al. |
| 8,093,828 | B2 | 1/2012 | Nagumo |
| 8,098,271 | B2 | 1/2012 | Tsuchiya |
| 8,174,028 | B2 | 5/2012 | Ogihara et al. |
| 8,184,140 | B2 | 5/2012 | Sowa et al. |
| 8,194,111 | B2 | 6/2012 | Ohno |
| 8,258,537 | B2 | 9/2012 | Igari et al. |
| 8,274,539 | B2 | 9/2012 | Ohno |
| 8,274,742 | B2 | 9/2012 | Yamamura |
| 8,278,667 | B2 | 10/2012 | Murata et al. |
| 8,294,963 | B2 | 10/2012 | Yaji |
| 8,300,076 | B2 | 10/2012 | Nomura et al. |
| 8,305,415 | B2 | 11/2012 | Ohno |
| 8,310,514 | B2 | 11/2012 | Yamaguchi et al. |
| 8,325,210 | B2 | 12/2012 | Ohno |
| 8,331,825 | B2 | 12/2012 | Itabashi |
| 8,343,848 | B2 | 1/2013 | Ogihara et al. |
| 8,345,074 | B2 | 1/2013 | Okazaki |
| 8,368,734 | B2 | 2/2013 | Tsuchiya et al. |
| 8,384,221 | B2 | 2/2013 | Suzuki et al. |
| 8,421,836 | B2 | 4/2013 | Okazaki |
| 8,450,671 | B2 | 5/2013 | Ohno et al. |
| 8,502,849 | B2 | 8/2013 | Ohno |
| 8,508,566 | B2 | 8/2013 | Ohno |
| 2001/0038368 | A1 | 11/2001 | Iida |
| 2003/0007063 | A1 | 1/2003 | Ohno |
| 2006/0192843 | A1 | 8/2006 | Ohba |
| 2008/0251798 | A1 | 10/2008 | Ogihara et al. |
| 2008/0252713 | A1 | 10/2008 | Horikawa |
| 2009/0315965 | A1 | 12/2009 | Yamagata et al. |
| 2010/0109024 | A1 | 5/2010 | Yonehara et al. |
| 2010/0110157 | A1 | 5/2010 | Yonehara et al. |
| 2010/0177400 | A1 | 7/2010 | Yamamura |
| 2010/0202800 | A1 | 8/2010 | Sowa et al. |
| 2010/0225730 | A1 | 9/2010 | Taniwaki et al. |
| 2010/0225932 | A1 | 9/2010 | Kurose et al. |
| 2010/0259592 | A1 | 10/2010 | Minabe et al. |
| 2011/0069132 | A1* | 3/2011 | Ohno ..... B41J 2/45 347/224 |
| 2011/0081738 | A1 | 4/2011 | Ogihara et al. |
| 2011/0234740 | A1 | 9/2011 | Ohno |
| 2011/0274465 | A1 | 11/2011 | Ohno |
| 2011/0284917 | A1 | 11/2011 | Murata et al. |
| 2012/0120176 | A1 | 5/2012 | Kinoshita et al. |
| 2012/0212566 | A1 | 8/2012 | Kikuchi et al. |
| 2012/0242771 | A1 | 9/2012 | Fukunaga |
| 2012/0249712 | A1 | 10/2012 | Ohno |
| 2012/0256998 | A1 | 10/2012 | Inoue |
| 2012/0274993 | A1 | 11/2012 | Yamamura |
| 2012/0300308 | A1 | 11/2012 | Yamamura |
| 2013/0169997 | A1 | 7/2013 | Ohno et al. |

OTHER PUBLICATIONS

US 8,124,987, 02/2012, Kondoh (withdrawn)

* cited by examiner

LIGHT-EMITTING ELEMENT ARRAY MODULE AND METHOD OF CONTROLLING LIGHT-EMITTING ELEMENT ARRAY CHIPS

CROSS-REFERENCE TO RELATED APPLICATIONS

This application is related to, and claims the priority benefit of, Korean Patent Application No. 10-2014-0011734, filed on Jan. 29, 2014, in the Korean Intellectual Property Office, the disclosure of which is incorporated herein in its entirety by reference.

BACKGROUND

1. Field

One or more embodiments relate to light-emitting element array modules and methods of controlling light-emitting element array chips.

2. Description of the Related Art

An image forming apparatus using light-emitting element array chips receives print data from a personal computer (PC) and forms an image by using light-emitting elements. When the light-emitting elements emit light, an electrostatic latent image is formed on a photoconductor drum in the image forming apparatus. Thereafter, a print image is output through development, transfer, and fusing processes.

The light-emitting element array chips may be connected to a control unit by wire bonding. Therefore, as many wire bondings as the number of signals output from the control unit are required.

SUMMARY

One or more embodiments include light-emitting element array modules and methods of controlling light-emitting element array chips.

Additional aspects will be set forth in part in the description which follows and, in part, will be apparent from the description, or may be learned by practice of the presented embodiments.

According to one or more embodiments, a light-emitting element array module includes a control driver configured to receive print data and operate according to the received print data, and light-emitting element array chips configured to receive a signal from the control driver and operate according to the received signal, wherein the control driver applies a start signal to a transfer element array by using a signal applied to a light-emitting element array of the light-emitting element array chips.

The control driver may control an operation point of the light-emitting element array chips by separately applying a start signal to the light-emitting element array chips.

The control driver may correct a registration error in a main scanning direction of the light-emitting element array chips by controlling a timing to apply a start signal to the light-emitting element array chips according to the registration error.

The control driver may correct an image in a main scanning direction by controlling an exposure timing by controlling a timing of a start signal input to the light-emitting element array chips.

The transfer element array may include a plurality of transfer elements, and the control driver may apply a start signal having a higher voltage than a high-level voltage of a transfer signal for controlling on/off of the transfer elements.

According to one or more embodiments, a light-emitting element array module includes a control driver configured to receive print data and operate according to the received print data, and light-emitting element array chips including a light-emitting element array and a transfer element array, wherein a start signal input terminal of the transfer element array and a data signal input terminal of the light-emitting element array are connected to an output terminal of the control driver.

The light-emitting element array module may include a voltage drop element connected between the start signal input terminal of the transfer element array and the data signal input terminal of the light-emitting element array.

The light-emitting element array module may include a diode connected in a forward direction between the start signal input terminal of the transfer element array and the data signal input terminal of the light-emitting element array.

The light-emitting element array module may include a Zener diode connected between the start signal input terminal of the transfer element array and the data signal input terminal of the light-emitting element array.

The light-emitting element array module may include a resistor connected between the start signal input terminal of the transfer element array and the data signal input terminal of the light-emitting element array.

The control driver may include a memory storing information about an operation point of the light-emitting element array chips.

The light-emitting element array may include a plurality of light-emitting thyristors, and the transfer element array may include a plurality of transfer thyristors.

The control driver may include a data transfer unit configured to output a data signal indicating on/off of light-emitting elements, and a start signal generating unit configured to output a start signal for operating transfer elements.

The control driver may include a switch configured to connect any one of the data transfer unit and the start signal generating unit to an on-signal output terminal.

According to one or more embodiments, a method of controlling light-emitting element array chips includes receiving print data, and controlling the light-emitting element array chips based on the print data, wherein the controlling of the light-emitting element array chips includes applying a start signal to a transfer element array by using a signal applied to a light-emitting element array of the light-emitting element array chips.

According to one or more embodiments, an image forming apparatus includes, a control driver configured to operate according to print data received from a personal computer (PC), and a light-emitting element array module configured to form an electrostatic latent image under the control of the control driver, wherein the light-emitting element array module includes light-emitting element array chips including a light-emitting element array and a transfer element array, and a start signal input terminal of the transfer element array and a data signal input terminal of the light-emitting element array are connected to an output terminal of the control driver.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1:
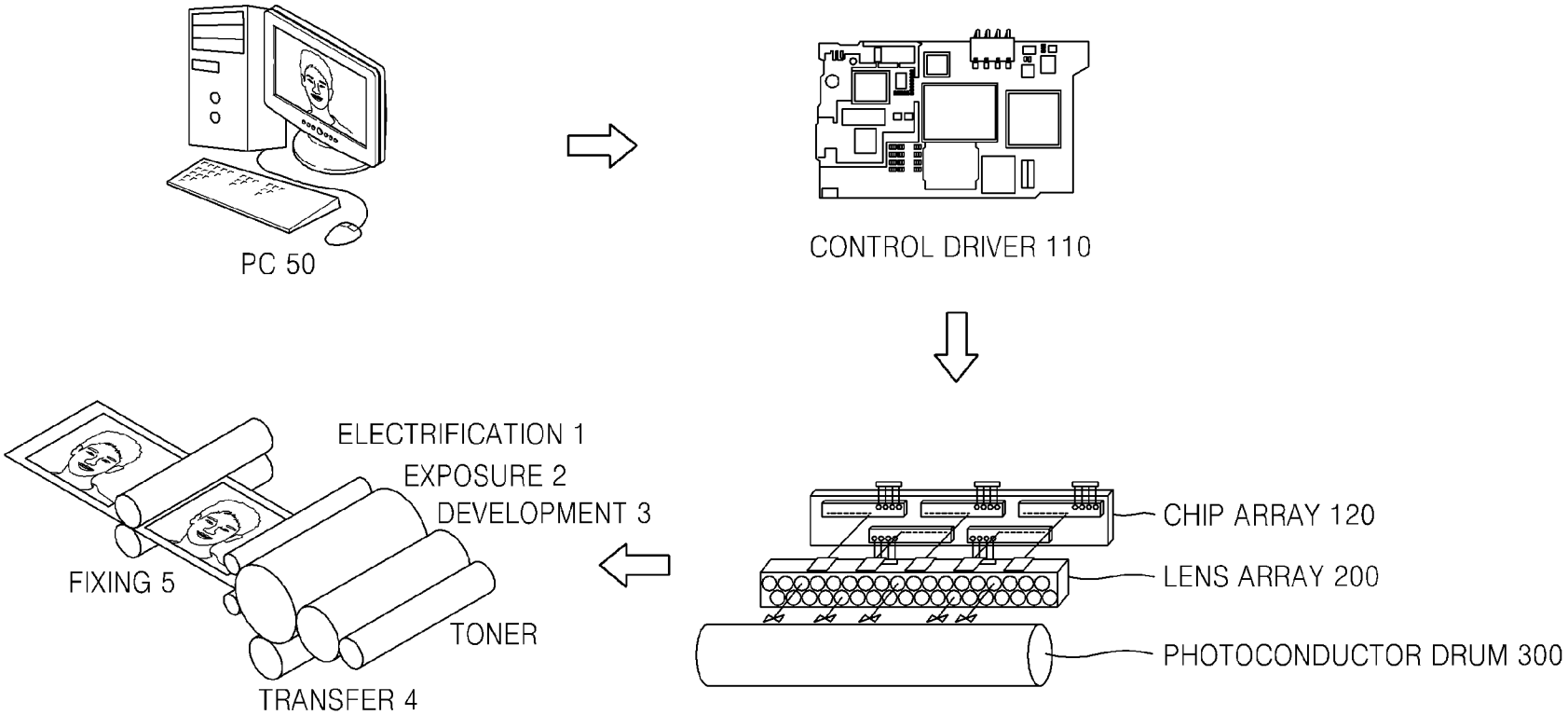
FIG. 1 is a diagram illustrating an exemplary process of outputting an image by using a light-emitting element array.

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects of the present description. As used herein, the term "and/or" includes any and all combinations of one or more of the associated listed items. Expressions such as "at least one of," when preceding a list of elements, modify the entire list of elements and do not modify the individual elements of the list.

Various embodiments and modifications, and exemplary embodiments are illustrated in the drawings and are described in detail. However, it will be understood that exemplary embodiments include modifications, equivalents, and substitutions falling within the spirit and scope of the present invention.

Although terms such as "first" and "second" may be used herein to describe various elements or components, these elements or components should not be limited by these terms. These terms are used to distinguish one element or component from another element or component.

The terms used herein describe exemplary embodiments and are not intended to limit the scope of the present invention. As used herein, the singular forms "a", "an", and "the" are intended to include the plural forms as well, unless the context clearly indicates otherwise. It will be understood that terms such as "comprise", "include", and "have", when used herein, do not preclude the presence or addition of one or more other features, integers, steps, operations, elements, components, or combinations thereof.

Hereinafter, embodiments are described in detail with reference to the accompanying drawings. In the following description, like reference numerals denote like elements, and redundant descriptions thereof are omitted.

FIG. 1 is a diagram illustrating a process of outputting an image by using a light-emitting element array. As illustrated in FIG. 1, upon receiving print data from a personal computer (PC) 50, an image forming apparatus performs operations for outputting an image.

The image forming apparatus forms an electrostatic latent image on a photoconductor drum 300 by using light-emitting elements and outputs an image through development, transfer, and fusing processes including electrification 1, exposure 2, development 3, transfer 4 and fixing 5.

The image forming apparatus includes a control driver 110, a chip array 120, a lens array 200, and the photoconductor drum 300.

The control driver 110 controls the chip array 120 according to the print data received from the PC 50. The chip array 120 includes a plurality of light-emitting element array chips. The control driver 110 may separately control the light-emitting element array chips. An exemplary method of controlling light-emitting element array chips by the control driver 110 is illustrated in FIG. 2.

The lens array 200 is arranged in an axial direction (i.e., a main scanning direction) of the photoconductor drum 300. Light having passed through the lens array 200 forms an image on a surface of the photoconductor drum 300.

The photoconductor 300 is exposed to light to form an electrostatic latent image. A developer (not shown) develops the electrostatic latent image formed on the photoconductor drum 300.

Figure 2:
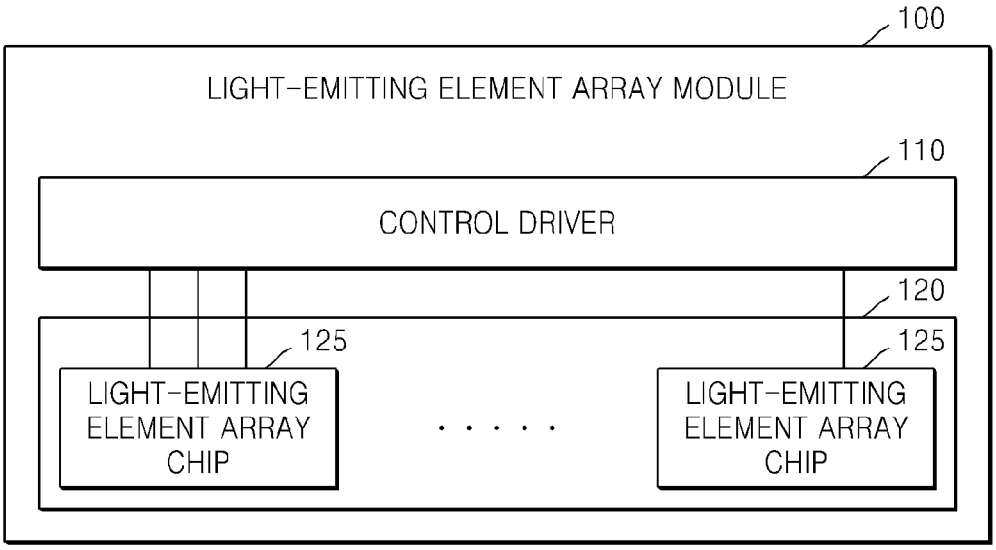
FIG. 2 is a diagram illustrating a light-emitting element array module according to an embodiment.

FIG. 2 is a diagram illustrating a light-emitting element array module 100 according to an embodiment. As illustrated in FIG. 2, the light-emitting element array module 100 may correct a registration error of light-emitting element array chips 125. A registration error in the main scanning direction may exist between the light-emitting element array chips 125. When light-emitting element array chips 125 emit light at the same point, the registration error between the light-emitting element array chips 125 may not have been corrected. Thus, the light-emitting element array module 100 may correct the registration error of the light-emitting element array chips 125 by separately controlling the light-emitting element array chips 125.

The control driver 110 receives print data and operates according to the received print data. The control driver 110 receives print data from a central processing unit (CPU) or a main board included in the image forming apparatus, and controls the on/off of light-emitting elements according to the received print data. The print data is data representing an image to be formed. The control driver 110 controls the on/off of the light-emitting elements according to the print data, and controls a start point of the light-emitting element array chips 125 in consideration of the registration error of the light-emitting element array chips 125.

The control driver 110 includes a memory storing information about an operation point of the light-emitting element array chips 125. In other words, the control driver 110 prestores information about a registration error of the light-emitting element array chips 125, and prestores information about the operation point of the light-emitting element array chips 125 in the memory according to the registration error.

The control driver 110 controls the operation point of the light-emitting element array chips 125 by separately applying a start signal to the light-emitting element array chips 125. The control driver 110 corrects a registration error in the main scanning direction of the light-emitting element array chips 125 by controlling a timing to apply the start signal to the light-emitting element array chips 125 according to the registration error. In other words, the control driver 110 corrects an image in the main scanning direction by controlling an exposure timing by controlling a timing of the start signal input to the light-emitting element array chips 125.

The control driver 110 does not output the start signal to the light-emitting element array chip 125, for example, whose print data is all white, among the light-emitting element array chips 125. When the light-emitting element array chip 125 does not need to emit light, the control driver 110 does not output the start signal to the light-emitting element array chip 125. Since the control driver 110 may separately control the light-emitting element array chips 125, the control driver 110 does not output the start signal to the light-emitting element array chip 125, for example, whose print data is all white, thereby reducing unnecessary power consumption. When print data is all white, there may be no print data, that is, there may be no image to be formed.

The light-emitting element array module 100 includes the control driver 110 and the chip array 120. The chip array 120 includes a plurality of light-emitting element array chips 125. The control driver 110 and the light-emitting element array chips 125 may be connected by wires.

The light-emitting element array chips 125 receive a signal from the control driver 110 and operate according to the received signal. The light-emitting element array chips 125 operate according to the start signal received from the control driver 110, and emit light according to an on signal. The light-emitting element array chips 125 may be arranged, for example, in a zigzag manner, for example, in lines, e.g., in two lines.

Figure 3:
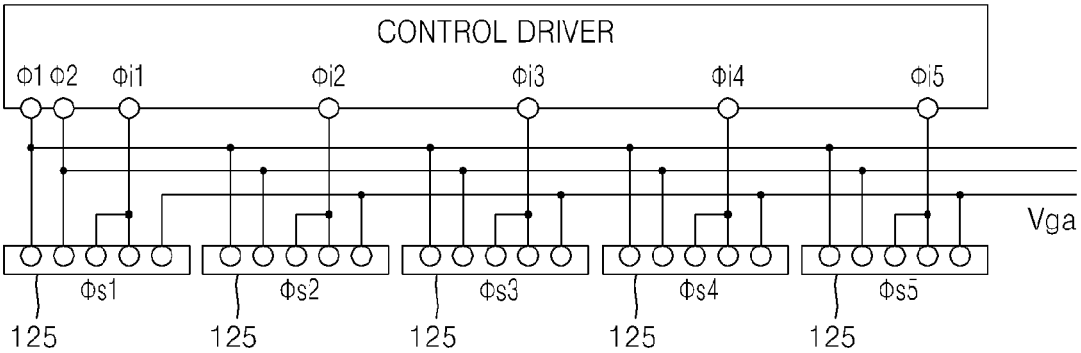
FIG. 3 is a diagram illustrating an example of a light-emitting element array module according to an embodiment.

FIG. 3 is a diagram illustrating an example of the light-emitting element array module 100 according to an embodiment.

The control driver 110 outputs the start signal and the on signal to the light-emitting element array chips 125 through terminals ϕi1 to ϕi5. Thus, the control driver 110 may separately control the light-emitting element array chips 125. The start signal and the on signal may be distinguished from each other by signal levels.

Terminals ϕs1 to ϕs5 of the light-emitting element array chips 125 may be connected in parallel to the terminals ϕi1 to ϕi5 of the light-emitting element array chips 125, respectively. For example, the terminals ϕi1 and ϕs1 of the light-emitting element array chips 125 may be connected in parallel to each other. Thus, a separate wire for connecting the control driver 110 and the terminals ϕs1 to ϕs5 of the light-emitting element array chips 125 is not necessary.

The control driver 110 outputs a transfer signal through terminals ϕ1 and ϕ2. The same ϕ1 transfer signal and ϕ2 transfer signal are received by the light-emitting element array chips 125.

Figure 4:
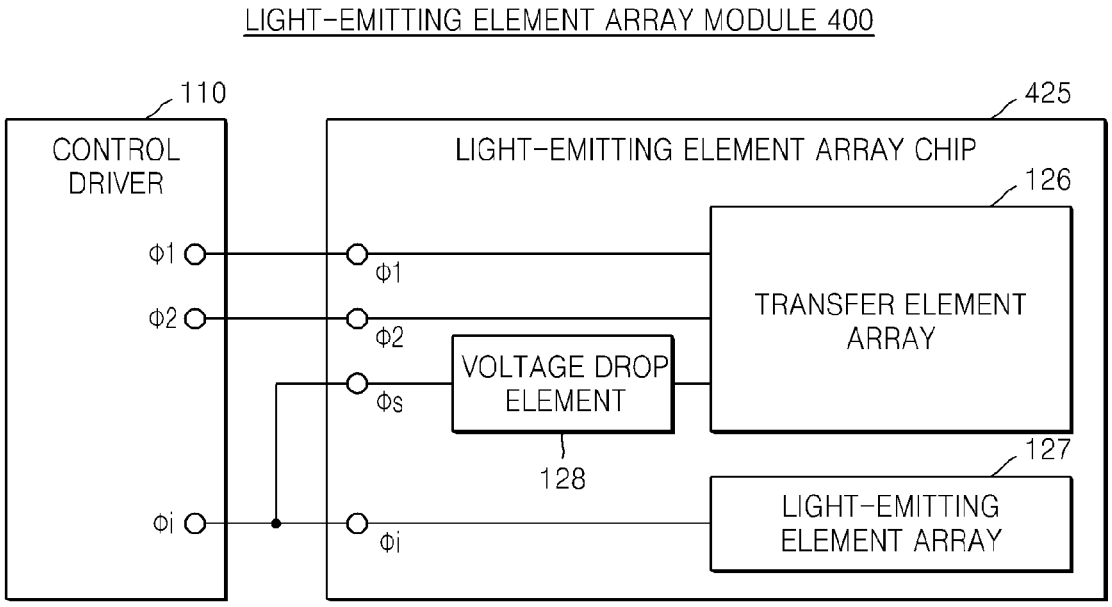
FIG. 4 is an exemplary block diagram of a light-emitting element array module according to an embodiment.

FIG. 4 is an exemplary block diagram of a light-emitting element array module 400 according to an embodiment. As illustrated in FIG. 4, a voltage drop element 128 may be connected between a transfer element array 126 and a terminal ϕs of the light-emitting element array chip 425.

The control driver 110 applies signals to the transfer element array 126 and a light-emitting element array 127 of the light-emitting element array chips 425.

The transfer element array 126 includes a plurality of transfer elements that operate based on a start signal and a transfer signal.

The light-emitting element array 127 includes a plurality of light-emitting elements that operate based on an on signal.

The light-emitting conditions of the light-emitting elements may be determined according to the states of the transfer elements. The transfer elements and the light-emitting elements may be one-to-one matched. In order for a light-emitting element to emit light, a transfer element corresponding to the light-emitting element has to be in a standby state. When the transfer element is in a standby state, the on/off of the light-emitting element may be determined according to an on signal input to the light-emitting element. When a start signal is input to the transfer elements, the transfer elements sequentially enter a standby state according to a transfer signal.

The control driver 110 outputs a start signal to the transfer element array 126 by using a signal applied to the light-emitting element array 127. The control driver 110 outputs a start signal to the transfer element array 126 through a terminal ϕi. After outputting the start signal, the control driver 110 outputs an on signal to the light-emitting element array 127 through the terminal ϕi.

The start signal input through the terminal ϕi of the control driver 110 is input to the transfer element array 126 through the voltage drop element 128. The voltage drop element 128 reduces the voltage of an input signal.

A start signal input terminal (terminal ϕs) of the transfer element array 126 and an on-signal input terminal (terminal ϕi) of the light-emitting element array 127 may be connected to an output terminal (terminal ϕi) of the control driver 110. Thus, the signal (ϕi signal) output from the control driver 110 may be input simultaneously to the transfer element array 126 and the light-emitting element array 127. Thus, the start signal input terminal (terminal ϕs) of the transfer element array 126 and the control driver 110 are not connected by a separate wire.

The transfer element array 126 includes a plurality of transfer elements, and the light-emitting element array 127 includes a plurality of light-emitting elements. The transfer elements may be controlled by a start signal and transfer signals (ϕ1 and ϕ2 signals). The light-emitting element array 127 may be turned on according to the state of the transfer element and the on signal.

The control driver 110 applies a start signal having a higher voltage than a high-level voltage of a transfer signal for controlling the on/off of the transfer elements. The start signal may be applied only once.

The transfer signal may have two alternate potentials. When a first voltage is a high-level voltage, a second voltage is a low-level voltage.

The start signal may have a higher level than the first voltage. The voltage level of the start signal may be determined according to the type and characteristics of the voltage drop element 128.

Figure 5:
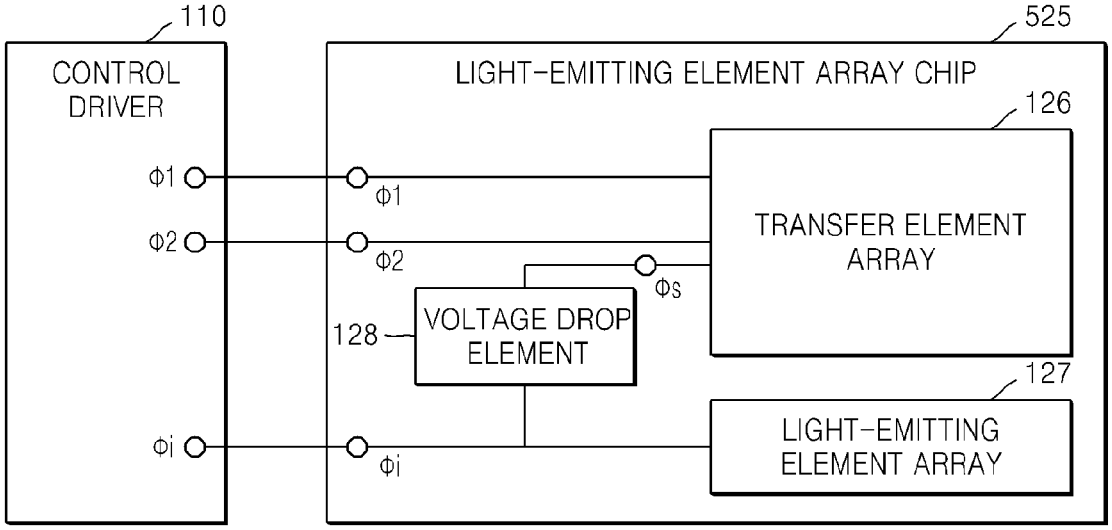
FIG. 5 is an exemplary block diagram of a light-emitting element array module according to an embodiment.

FIG. 5 is an exemplary block diagram of a light-emitting element array module 500 according to an embodiment. As illustrated in FIG. 5, a voltage drop element 128 is connected between a terminal ϕs of the light-emitting element array chip 125 and a terminal ϕi of the light-emitting element array chip 525. The voltage drop element 128 may be connected inside the light-emitting element array chip 525. Thus, a signal received through the terminal ϕi of the light-emitting element array chip 525 may be applied to the light-emitting element array 127 and the voltage drop element 128.

Figure 6:
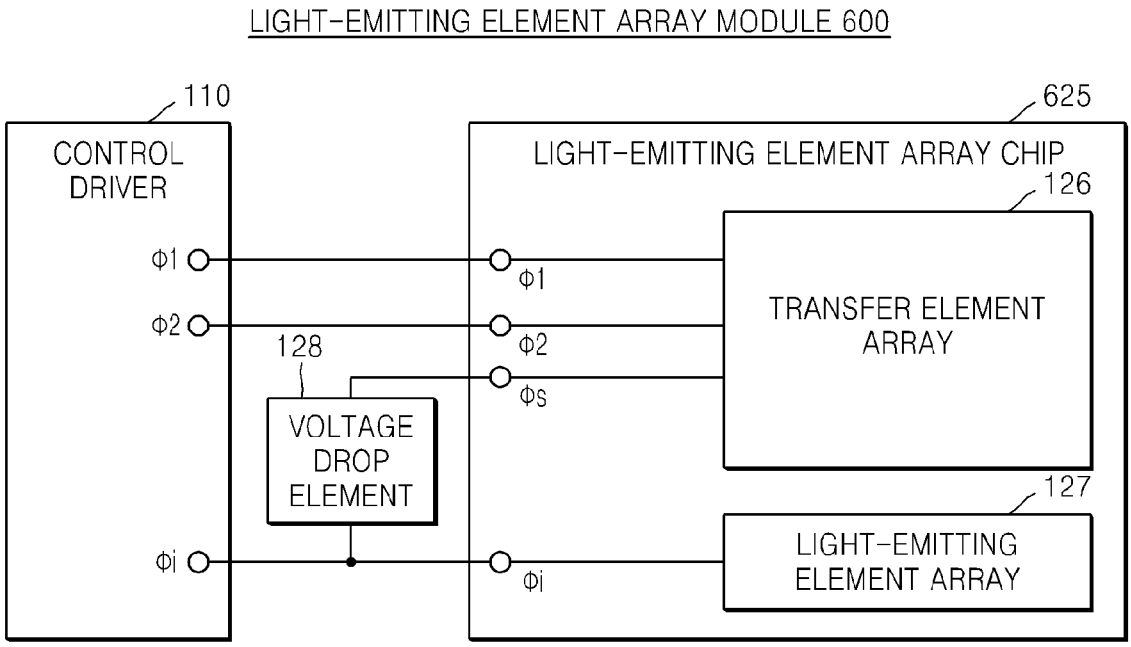
FIG. 6 is an exemplary block diagram of a light-emitting element array module according to an embodiment.

FIG. 6 is an exemplary block diagram of a light-emitting element array module 600 according to an embodiment. As illustrated in FIG. 6, a voltage drop element 128 is connected between a terminal ϕi of the control driver 110 and a terminal ϕs of the light-emitting element array chip 125. FIG. 6 illustrates a case where the voltage drop element 128 is connected outside the light-emitting element array chip 625.

Figure 7:
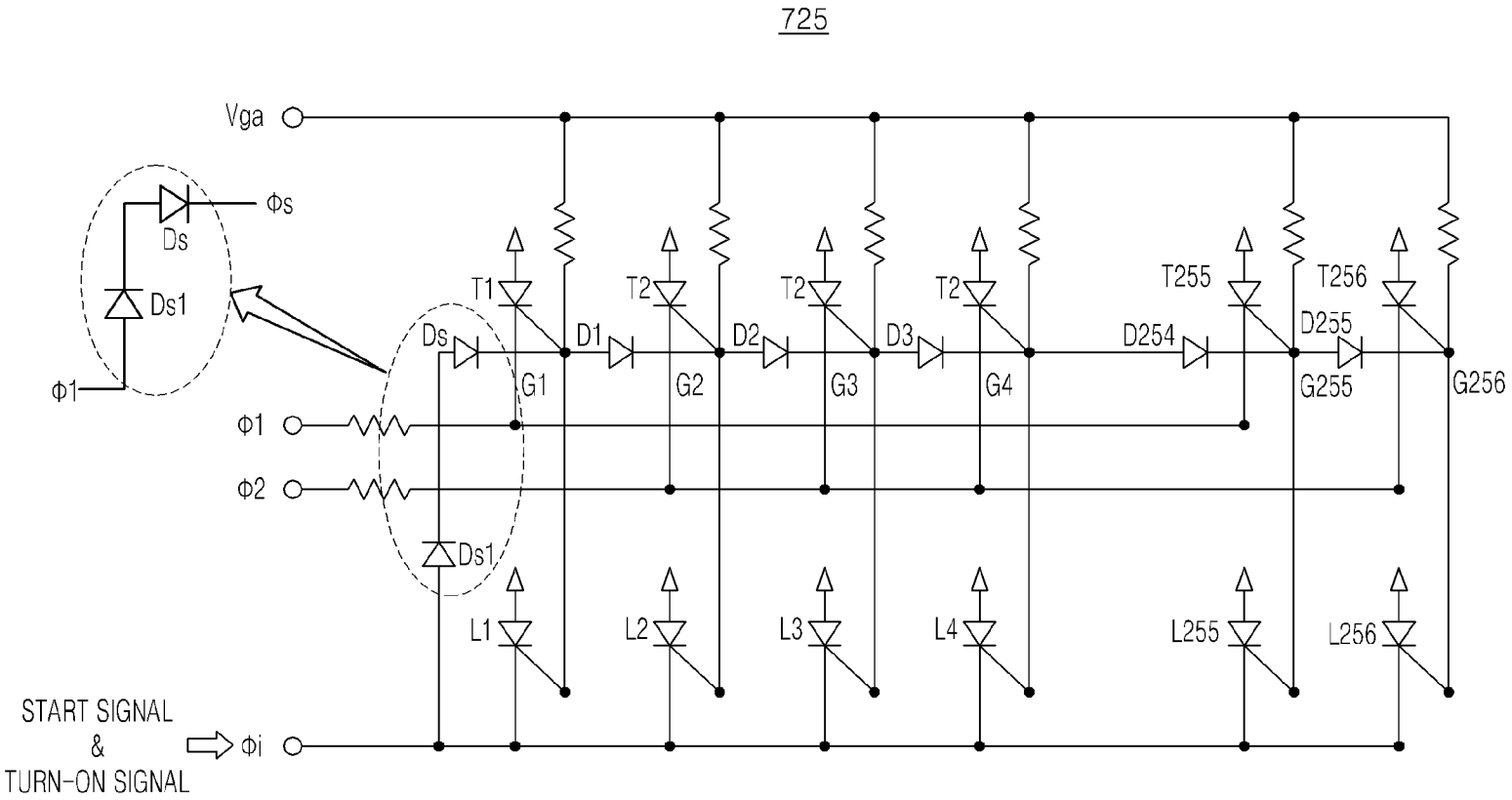
FIG. 7 is a diagram illustrating an example of a light-emitting element array chip according to an embodiment.

FIG. 7 is a diagram illustrating an example of the light-emitting element array chip 725 according to an embodiment. As illustrated in FIG. 7, the light-emitting element array chip 725 uses a diode as a voltage drop element.

The light-emitting element array chip 725 includes two diodes Ds and Ds1 that that may be connected in a forward direction. When the diodes Ds and Ds1 are connected in a forward direction and a voltage of a predetermined level or more is applied to the terminal ϕi, a current flows through the diodes Ds and Ds1. Since a voltage of a signal having passed through the diodes Ds and Ds1 is reduced, a voltage of the terminal ϕs is lower than a voltage of the terminal ϕi. The voltage of the terminal ϕs is sufficient to operate the transfer element. A level of the voltage of the start signal is determined by a voltage drop level of the diodes Ds and Ds1.

A start signal and an on signal are input to the terminal ϕi of the light-emitting element array chip 125. The level of the voltage of the start signal is higher than the maximum level of the voltage of the on signal. Thus, before the start signal is input to the light-emitting element array chip 125, the transfer element or the light-emitting elements do not operate.

The diode connected in a forward direction may be connected between the start signal input terminal (terminal ϕs) of the transfer element array and the on-signal input terminal (terminal ϕi) of the light-emitting element array. The diodes may be connected as illustrated in FIGS. 4 and 5. While two diodes Ds and Ds1 are illustrated in FIG. 7, one diode or three or more diodes may be used.

Operations of the transfer elements and the light-emitting elements are disclosed.

The light-emitting element array includes a plurality of light-emitting thyristors, and the transfer element array includes a plurality of transfer thyristors. In other words, the light-emitting elements may be light-emitting thyristors, and the transfer elements may be transfer thyristors.

The thyristor has a PNPN junction and includes a gate. FIG. 7 illustrates a case where 256 thyristors are included on one light-emitting element array chip 725, and G1 and G256 respectively denote gate terminals of the thyristors. When a voltage of a predetermined level or more is applied to a gate of the thyristor, since a breakdown voltage of the thyristor is lowered, an operation voltage of the thyristor is lowered. Thus, by applying a voltage to the gate of the thyristor, the thyristor may be operated by a lower driving voltage.

The start signal supplies a voltage to a gate G1 of a transfer thyristor T1. The start signal is supplied to the gate G1 through the diodes Ds1 and Ds. The start signal has a voltage level that may operate the transfer thyristor T1 even after a voltage drop. After passing through the diodes Ds1 and Ds, due to a voltage drop, the on signal fails to have a voltage level that may operate the transfer thyristor T1. Thus, at an initial state, only the start signal may enable the transfer thyristors T1 to T256 to be in an operating state. Thereafter, the transfer thyristors T1 to T256 sequentially enter an operating state according to the transfer signal.

The transfer thyristor enters an operating state by the transfer signals (ϕ1 signal and ϕ2 signal). When the start signal is applied to the gate G1 of the transfer thyristor T1 and the transfer signal (ϕ1 signal) is applied to the transfer thyristor T1, the transfer thyristor T1 enters an operating state.

When the transfer thyristor T1 is in an operating state, the light-emitting thyristor L1 enters a light-emitting state. The gate G1 of the transfer thyristor T1 is equal to the gate of the light-emitting thyristor L1. Thus, when the transfer thyristor T1 enters an operating state, the light-emitting thyristor L1 also enters an operating state. When the light-emitting thyristor L1 is in an operating state, the light-emitting thyristor L1 emits light according to the on signal input through the terminal ϕi.

By repetition of the process, the transfer thyristors T1 to T256 sequentially enter an operating state, the light-emitting thyristors L1 to L256 enter an operating state, and the light-emitting thyristors sequentially emit light or do not emit light.

Figure 8:
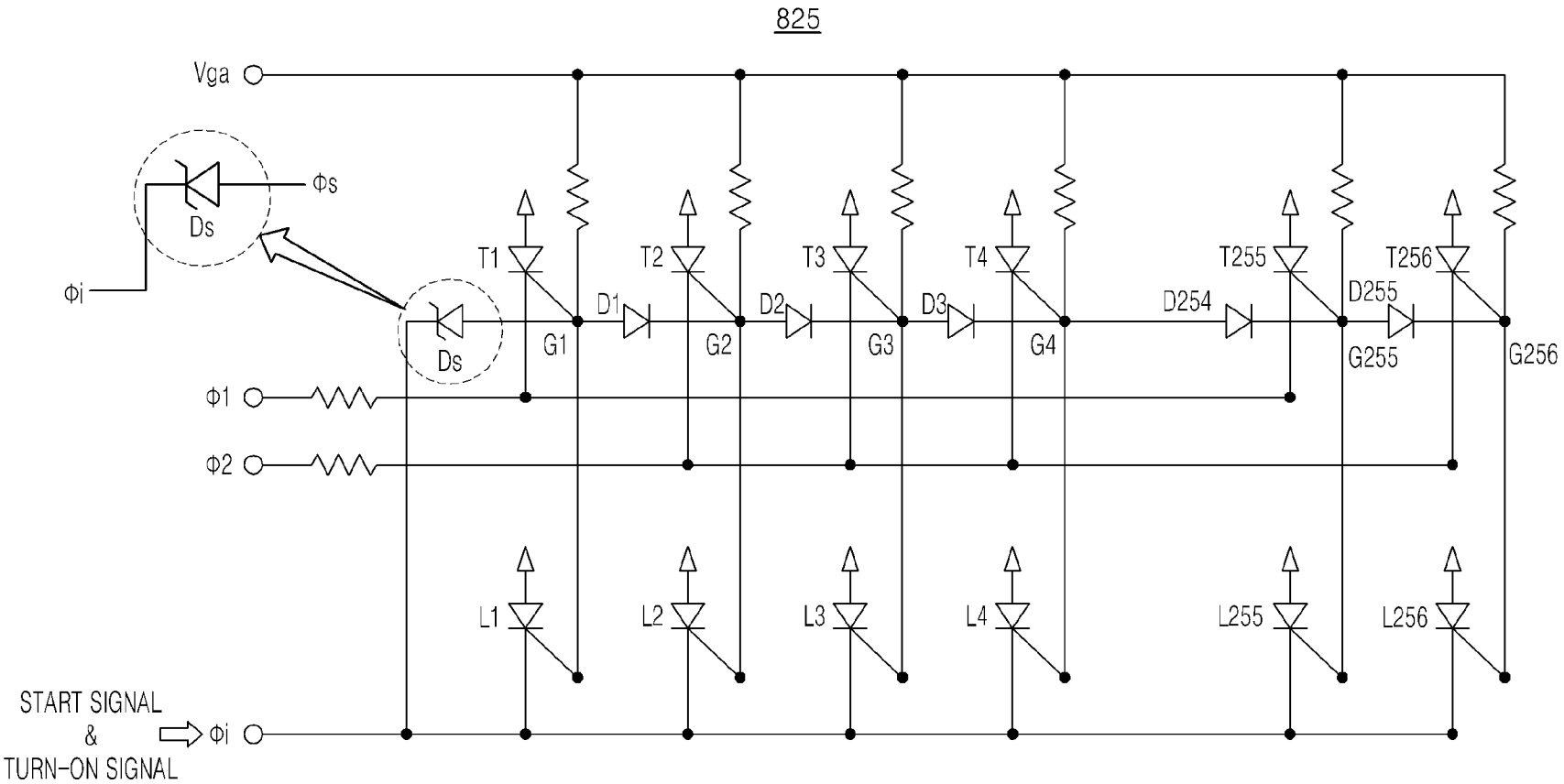
FIG. 8 is a diagram illustrating an example of a light-emitting element array chip according to an embodiment.

FIG. 8 is a diagram illustrating an example of the light-emitting element array chip 825 according to an embodiment. As illustrated in FIG. 8, the light-emitting element array chip 825 uses a Zener diode as a voltage drop element.

The light-emitting element array chip 825 includes Zener diodes Ds that are connected in a reverse direction. When the Zener diodes Ds are connected in a reverse direction and a voltage of a predetermined level or more is applied to the terminal ϕi, a current flows through the Zener diodes Ds. Since a voltage of a signal having passed through the Zener diode Ds is reduced, a voltage of the terminal ϕs is lower than a voltage of the terminal ϕi. Thus, a voltage level of the start signal is determined by a level of a breakdown voltage of the Zener diode Ds.

The Zener diode Ds connected in a reverse direction may be connected between the start signal input terminal (terminal ϕs) of the transfer element array and the on-signal input terminal (terminal ϕi) of the light-emitting element array. The Zener diodes may be connected as illustrated in FIGS. 4 and 5. While one Zener diode Ds is illustrated in FIG. 8, two or more Zener diodes Ds may be used.

Figure 9:
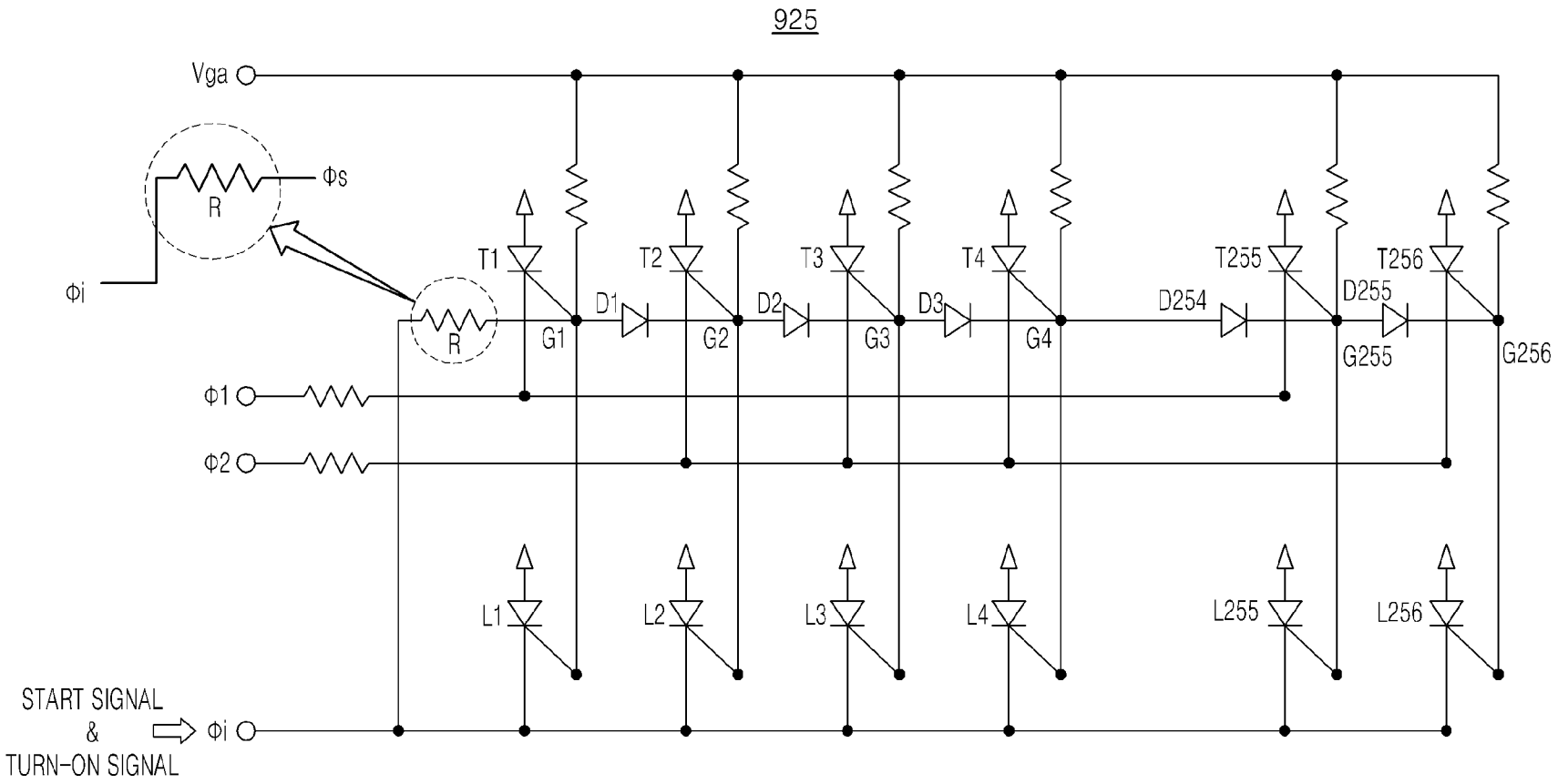
FIG. 9 is a diagram illustrating an example of a light-emitting element array chip according to an embodiment.

FIG. 9 is a diagram illustrating an example of the light-emitting element array chip 925 according to an embodiment. As illustrated in FIG. 9, the light-emitting element array chip 925 uses a resistor as a voltage drop element.

The light-emitting element array chip 925 includes at least one resistor R. When a voltage of a predetermined level or more is applied to the terminal ϕi, a current flows through the resistor R. Since a voltage of a signal having passed through the resistor R is reduced, a voltage of the terminal ϕs is lower than a voltage of the terminal ϕi. Thus, a voltage level of the start signal is determined by a resistance value of the resistor R.

The resistor R may be connected between the start signal input terminal (terminal ϕs) of the transfer element array and the on-signal input terminal (terminal ϕi) of the light-emitting element array. The resistor R may be connected as illustrated in FIGS. 4 and 5. While one resistor R is illustrated in FIG. 9, two or more resistors may be used.

While FIGS. 7 to 9 illustrate a diode, a Zener diode, or a resistor as a voltage drop element, a combination of at least two of a diode, a Zener diode, and a resistor may be used as a voltage drop element. When two or more different elements are used as a voltage drop element, a voltage level of the start signal may be determined according to a level of a voltage drop caused by the two or more different elements.

Figure 10:
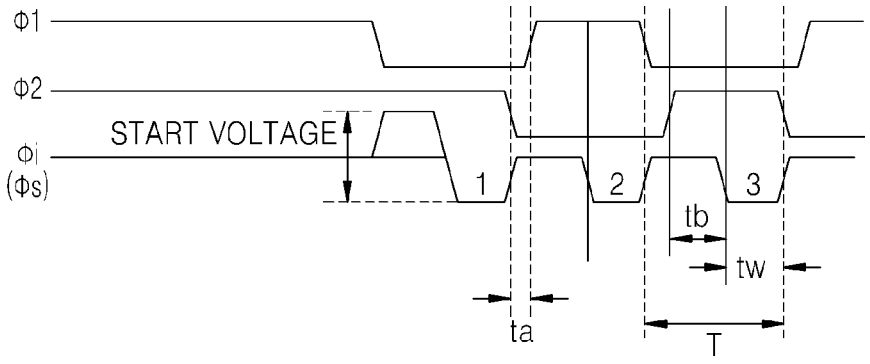
FIG. 10 is an exemplary timing diagram of signals output from a control driver.

FIG. 10 is an exemplary timing diagram of signals output from a control driver.

As illustrated in FIG. 10, the control driver outputs a start signal ϕs and an on signal ϕi through one terminal. The start signal ϕs is output before the on signal ϕi and has a voltage level higher than a maximum value of the on signal ϕi.

A first transfer signal ϕ1 may be applied to the odd-numbered transfer thyristors, and a second transfer signal ϕ2 may be applied to the even-numbered transfer thyristors.

The first transfer signal ϕ1 and the second transfer signal ϕ2 have two potentials of a high level and a low level and alternately enter a high state and a low state. The first transfer signal ϕ1 and the second transfer signal ϕ2 overlap with each other for a time ta. This is to allow the next transfer thyristor to enter a standby state before an operation of the previous transfer thyristor is ended. A time tb is a time predetermined for stable operation of the light-emitting element, and a time tw is a time when the light-emitting element actually operates.

When the start signal ϕs is input, the first transfer signal ϕ1 enters a low state and the first transfer thyristor T1 is turned on. The control driver 110 turns on the first light-emitting thyristor L1 by using the on signal ϕi. Thereafter, when the first transfer signal $\phi$1 enters a high state and the second transfer signal $\phi$2 enters a low state, the control driver 110 turns on the second light-emitting thyristor L2 by using the on signal $\phi$i. By repetition of the process, the control driver 110 may turn on the first to 256th light-emitting thyristors L1 to L256.

Figure 11:
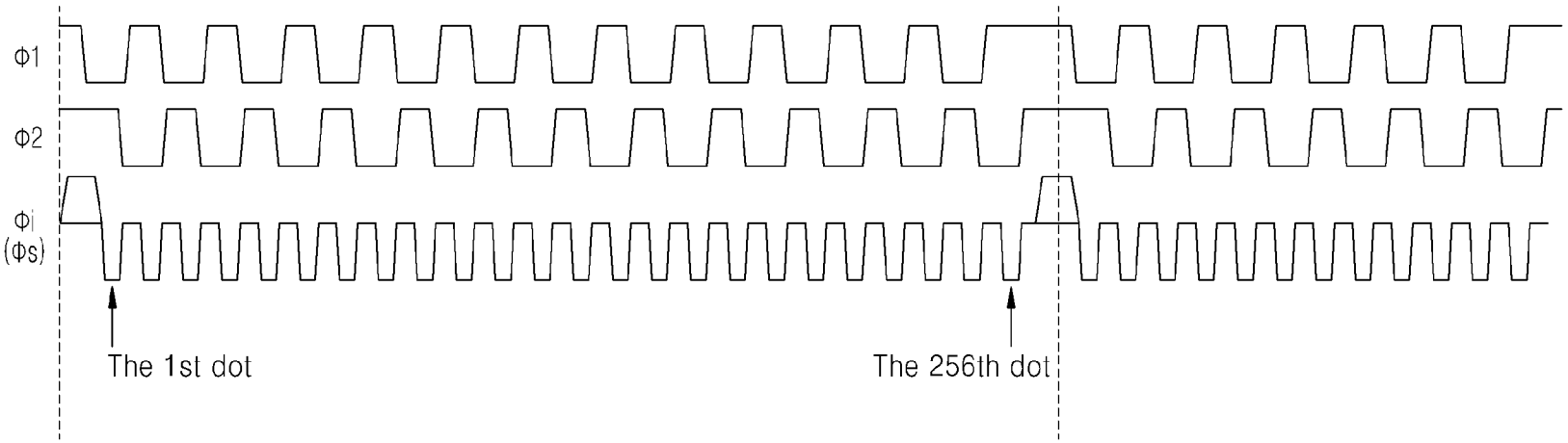
FIG. 11 is an exemplary timing diagram of signals output from the control driver.

FIG. 11 is an exemplary timing diagram of signals output from a control driver. As illustrated in FIG. 11, the control driver may sequentially turn on the light-emitting thyristors included in a light-emitting element array chip by applying the start signal once by performing a temporary switching operation. The control driver may sequentially turn on the light-emitting thyristors by applying the start signal again after the turn-on of all the light-emitting thyristors is ended.

Figure 12:
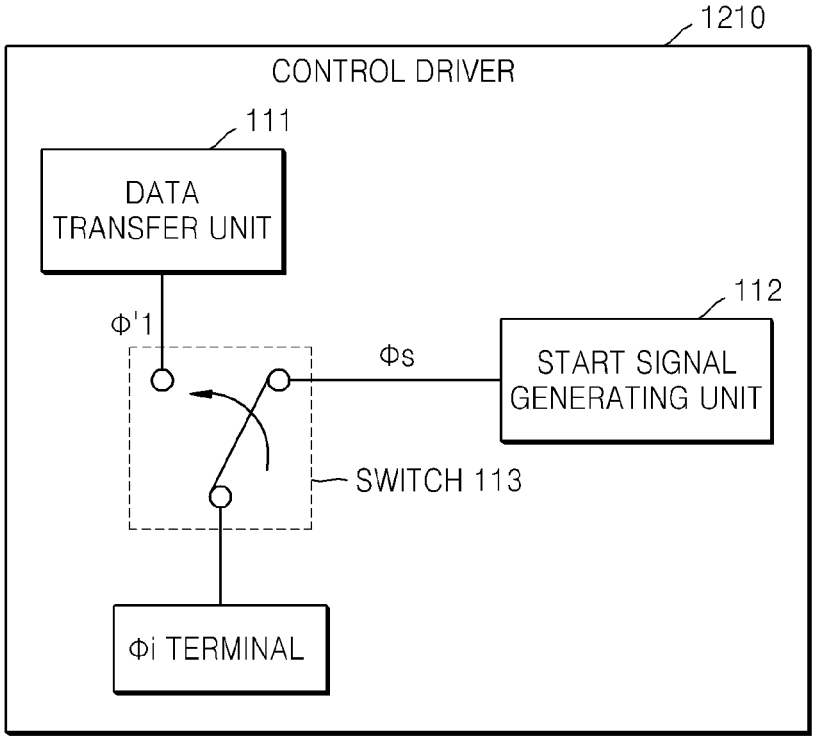
FIG. 12 is a diagram illustrating an exemplary method of transferring a start signal and a data signal.

FIG. 12 is a diagram illustrating a method of transferring the start signal and the data signal. As illustrated in FIG. 12, the control driver 1210 further includes a data transfer unit 111 and a start signal generating unit 112.

The data transfer unit 111 outputs a data signal $\phi$'I indicating the on/off of the light-emitting elements, and the start signal generating unit 112 outputs a start signal $\phi$s for operating the transfer elements.

By using a switch 113, the control driver 110 outputs the start signal $\phi$s and the data signal $\phi$'i to the terminal $\phi$i. By performing a switching operation, the control driver 110 connects the start signal generating unit 112 and the terminal $\phi$i to output the start signal $\phi$s and connects the data transfer unit 111 and the terminal $\phi$i to output the data signal $\phi$i.

Figure 13:
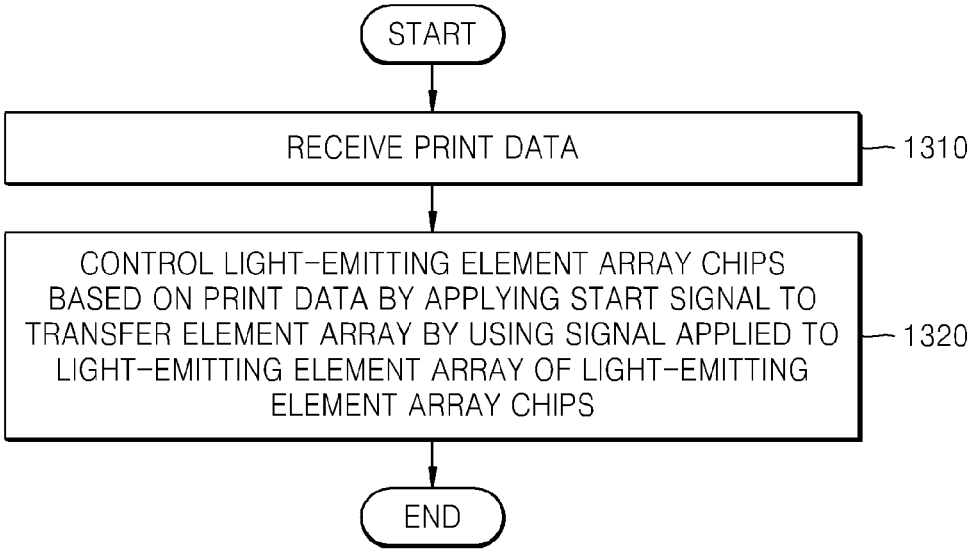
FIG. 13 is a flowchart of a method of controlling a light-emitting element array chip according to an embodiment.

FIG. 13 is a flowchart of a method of controlling a light-emitting element array chip according to an embodiment.

In operation 1310, the control driver, e.g., control driver 110 receives print data. The print data may be received from the CPU or the PC 50. The print data is data about an image that is to be printed by the image forming apparatus.

In operation 1320, the control driver, e.g., control driver 110 controls the light-emitting element array chips e.g., light-emitting array chips 125 based on the print data. The control driver 110 applies a start signal to the transfer element array 126 by using a signal applied to the light-emitting element array 127 of the light-emitting element array chips 125.

The control driver 110 controls an operation point of the light-emitting element array chips 125 by separately applying a start signal to the light-emitting element array chips 125. The chip array 120 includes a plurality of light-emitting element array chips 125. The control driver 110 may apply the start signal to the light-emitting element array chips 125 at different points.

The control driver 110 corrects a registration error in the main scanning direction of the light-emitting element array chips 125 by controlling a timing to apply the start signal to the light-emitting element array chips 125 according to the registration error. A registration error exists between the light-emitting element array chips 125, and the control driver 110 controls an operation point of the light-emitting element array chips 125 in order to correct the registration error. In other words, the control driver 110 corrects an image in the main scanning direction by controlling an exposure timing by controlling a timing of the start signal input to the light-emitting element array chips 125.

The control driver 110 applies a start signal having a higher voltage than a high-level voltage of a transfer signal for controlling the on/off of the transfer elements. In order to turn on/off the transfer elements, the control driver 110 applies a high-voltage or low-voltage transfer signal to the transfer elements. The start signal has a higher voltage than a high-level voltage of the transfer signal, and the transfer elements start operating when the start signal is applied to the transfer elements.

The control driver 110 transfers a data signal indicating an image to the light-emitting element array 127. The data signal indicates the on/off of the light-emitting elements.

According to the one or more embodiments, since both the start signal receiving terminal and the data signal receiving terminal of the light-emitting element array chip are connected to the on-signal output terminal of the control driver, the number of wire bondings in the light-emitting array module may be reduced.

According to an exemplary method of controlling the light-emitting element array chips, the light-emitting element array chips may be separately controlled by controlling the point when the start signal is output to each of the light-emitting element array chips.

According to an exemplary method of controlling the light-emitting element array chips, the registration error of the light-emitting element array chips may be corrected by separately controlling the light-emitting element array chips.

According to an exemplary method of controlling the light-emitting element array chips, when the image corresponding to the light-emitting element array chip is all white, the start signal is not output to the light-emitting element array chip and thus the transfer element array is not driven, thereby making it possible to reduce power consumption caused by the driving of the light-emitting element array chip.

The apparatuses according to an exemplary embodiment may include a processor, a memory for storing and executing program data, a permanent storage such as a disk drive, a communication port for communicating with an external device, and user interface (UI) devices such as a touch panel, keys, and buttons. Methods implemented by a software module or algorithm may be stored on a non-transitory computer-readable recording medium as computer-readable codes or program commands that are executable on the processor. Examples of the computer-readable recording medium include magnetic storage media (e.g., read-only memories (ROMs), random-access memories (RAMs), floppy disks, and hard disks) and optical recording media (e.g., compact disk-read only memories (CD-ROMs) and digital versatile disks (DVDs)). The computer-readable recording medium may also be distributed over network-coupled computer systems so that the computer-readable codes may be stored and executed in a distributed fashion. The computer-readable recording medium is readable by a computer, and may be stored in a memory and executed in a processor.

The embodiments may be described in terms of functional block components and various processing operations. An exemplary functional block may be implemented by hardware and/or software components. For example, an exemplary embodiments may employ various integrated circuit (IC) components, such as memory elements, processing elements, logic elements, and lookup tables, which may execute various functions under the control of one or more microprocessors or other control devices. An exemplary element elements may be implemented by software programming or software elements, and implemented by a programming or scripting language such as C, C++, Java, or assembly language, with various algorithms being implemented by a combination of data structures, processes, routines, or other programming elements. An exemplary functional aspect may be implemented by an algorithm that is executed in one or more processors. An exemplary "mechanism," "element," "unit," and "configuration" are not limited to mechanical and physical configurations, and may include software routines in conjunction with processors or the like.

Particular implementations described herein are merely exemplary, and do not limit the scope of the present invention. Connection lines or connection members illustrated in the drawings represent exemplary functional connections and/or physical or logical connections between the various elements, and various alternative or additional functional connections, physical connections, or logical connections may used.

The use of the terms "a," "an," and "the" and similar referents in the context of the specification (especially in the context of the following claims) may be construed to cover both the singular and the plural. Also, recitation of a range of values herein refer individually to each separate value falling within the range, unless otherwise indicated herein, and each separate value is incorporated into the specification as if it were individually recited herein. The operations of the method described herein may be performed in any suitable order unless otherwise indicated herein or otherwise clearly contradicted by the context. The scope of the present invention is not limited to the above-described operation order. Examples or exemplary terms (e.g., "such as") provided herein are used to describe the embodiments in detail, and the scope is not limited by the examples or exemplary terms unless otherwise claimed. Also, those of ordinary skill in the art will readily understand that various modifications and combinations may be made according to design conditions and factors without departing from the spirit and scope of the present invention as defined by the following claims.

It should be understood that the exemplary embodiments described herein should be considered in a descriptive sense only and not for purposes of limitation. Descriptions of features or aspects within each embodiment should typically be considered as available for other similar features or aspects in other embodiments.

While one or more embodiments of the present invention have been described with reference to the figures, it will be understood by those of ordinary skill in the art that various changes in form and details may be made therein without departing from the spirit and scope as defined by the following claims.

What is claimed is:

1. A light-emitting element array module comprising:

a control driver configured to receive print data and operate according to the received print data; and light-emitting element array chips configured to receive a signal from the control driver and operate according to the received signal, wherein the control driver applies a start signal to a transfer element array by using a signal applied to a light-emitting element array of the light-emitting element array chips.

2. The light-emitting element array module of claim 1, wherein the control driver controls an operation point of the light-emitting element array chips by separately applying a start signal to the light-emitting element array chips.

3. The light-emitting element array module of claim 1, wherein the control driver corrects a registration error in a main scanning direction of the light-emitting element array chips by controlling a timing to apply a start signal to the light-emitting element array chips according to the registration error.

4. The light-emitting element array module of claim 1, wherein the control driver corrects an image in a main scanning direction by controlling an exposure timing by controlling a timing of a start signal input to the light-emitting element array chips.

5. The light-emitting element array module of claim 1, wherein the transfer element array comprises a plurality of transfer elements, and the control driver applies a start signal having a higher voltage than a high-level voltage of a transfer signal for controlling on/off of the transfer elements.

6. A light-emitting element array module comprising:

a control driver configured to receive print data and operate according to the received print data; and light-emitting element array chips comprising a light-emitting element array and a transfer element array, wherein a start signal input terminal of the transfer element array and a data signal input terminal of the light-emitting element array are connected to an output terminal of the control driver.

7. The light-emitting element array module of claim 6, further comprising a voltage drop element connected between the start signal input terminal of the transfer element array and the data signal input terminal of the light-emitting element array.

8. The light-emitting element array module of claim 6, further comprising a diode connected in a forward direction between the start signal input terminal of the transfer element array and the data signal input terminal of the light-emitting element array.

9. The light-emitting element array module of claim 6, further comprising a Zener diode connected between the start signal input terminal of the transfer element array and the data signal input terminal of the light-emitting element array.

10. The light-emitting element array module of claim 6, further comprising a resistor connected between the start signal input terminal of the transfer element array and the data signal input terminal of the light-emitting element array.

11. The light-emitting element array module of claim 6, wherein the control driver comprises a memory storing information about an operation point of the light-emitting element array chips.

12. The light-emitting element array module of claim 6, wherein the light-emitting element array comprises a plurality of light-emitting thyristors, and the transfer element array comprises a plurality of transfer thyristors.

13. The light-emitting element array module of claim 6, wherein the control driver comprises:

a data transfer unit configured to output a data signal indicating on/off of light-emitting elements; and a start signal generating unit configured to output a start signal for operating transfer elements.

14. The light-emitting element array module of claim 13, wherein the control driver further comprises a switch configured to connect any one of the data transfer unit and the start signal generating unit to an on-signal output terminal.

15. A method of controlling light-emitting element array chips, the method comprising:

receiving print data; and controlling the light-emitting element array chips based on the print data, wherein the controlling of the light-emitting element array chips comprises applying a start signal to a transfer element array by using a signal applied to a light-emitting element array of the light-emitting element array chips.

16. The method of claim 15, wherein the controlling of the light-emitting element array chips comprises controlling an operation point of the light-emitting element array chips by separately applying a start signal to the light-emitting element array chips.

17. The method of claim 15, wherein the controlling of the light-emitting element array chips comprises correcting a registration error in a main scanning direction of the light-emitting element array chips by controlling a timing to apply a start signal to the light-emitting element array chips according to the registration error.

18. The method of claim 15, wherein the controlling of the light-emitting element array chips comprises correcting an image in a main scanning direction by controlling an exposure timing by controlling a timing of a start signal input to the light-emitting element array chips.

19. The method of claim 15, wherein the transfer element array comprises a plurality of transfer elements, and the controlling of the light-emitting element array chips comprises applying a start signal having a higher voltage than a high-level voltage of a transfer signal for controlling on/off of the transfer elements.

20. The method of claim 15, wherein the controlling of the light-emitting element array chips comprises transferring a data signal indicating an image to the light-emitting element array.

21. The method of claim 15, wherein, in the controlling of the light-emitting element array chips, a start signal is not applied to the light-emitting element array chip having no image to be formed, among the light-emitting element array chips.

22. A non-transitory computer-readable recording medium that stores a program that, when executed by a computer, performs the method of claim 15.

23. An image forming apparatus comprising:

a control driver configured to operate according to print data received from a personal computer (PC); and a light-emitting element array module configured to form an electrostatic latent image under control of the control driver, wherein the light-emitting element array module comprises light-emitting element array chips comprising a light-emitting element array and a transfer element array, and a start signal input terminal of the transfer element array and a data signal input terminal of the light-emitting element array are connected to an output terminal of the control driver.

24. The image forming apparatus of claim 23, further comprising a voltage drop element connected between the start signal input terminal of the transfer element array and the data signal input terminal of the light-emitting element array.

25. The image forming apparatus of claim 23, further comprising a diode connected in a forward direction between the start signal input terminal of the transfer element array and the data signal input terminal of the light-emitting element array.

26. The image forming apparatus of claim 23, further comprising a Zener diode connected between the start signal input terminal of the transfer element array and the data signal input terminal of the light-emitting element array.

27. The image forming apparatus of claim 23, further comprising a resistor connected between the start signal input terminal of the transfer element array and the data signal input terminal of the light-emitting element array.

28. The image forming apparatus of claim 23, wherein the control driver comprises a memory storing information about an operation point of the light-emitting element array chips.

29. The image forming apparatus of claim 23, wherein the light-emitting element array comprises a plurality of light-emitting thyristors, and the transfer element array comprises a plurality of transfer thyristors.

30. The image forming apparatus of claim 23, wherein the control driver comprises:

a data transfer unit configured to output a data signal indicating on/off of light-emitting elements; and a start signal generating unit configured to output a start signal for operating transfer elements.

* * * * *